US011248418B2

(12) United States Patent
Barker et al.

(10) Patent No.: US 11,248,418 B2
(45) Date of Patent: Feb. 15, 2022

(54) DRILLING MOTOR INTERIOR VALVE

(71) Applicant: BICO Drilling Tools, Inc., Houston, TX (US)

(72) Inventors: David Barker, Houston, TX (US); Kosay Ibrahim El-Rayes, Houston, TX (US)

(73) Assignee: BICO Drilling Tools, Inc, Houston, TX (US)

( * ) Notice: Subject to any disclaimer, the term of this patent is extended or adjusted under 35 U.S.C. 154(b) by 0 days.

(21) Appl. No.: 16/932,170

(22) Filed: Jul. 17, 2020

(65) Prior Publication Data

US 2020/0347677 A1 Nov. 5, 2020

Related U.S. Application Data

(63) Continuation-in-part of application No. 16/057,585, filed on Aug. 7, 2018, now abandoned.

(60) Provisional application No. 62/560,556, filed on Sep. 19, 2017, provisional application No. 62/542,259, filed on Aug. 7, 2017.

(51) Int. Cl.

| | |
|---|---|
| ***E21B 4/02*** | (2006.01) |
| ***E21B 21/10*** | (2006.01) |
| ***E21B 34/06*** | (2006.01) |
| ***E21B 21/08*** | (2006.01) |
| *E21B 4/00* | (2006.01) |

(52) U.S. Cl.

CPC ..... *E21B 4/02* (2013.01); *E21B 21/08* (2013.01); *E21B 21/10* (2013.01); *E21B 34/063* (2013.01); *E21B 4/003* (2013.01)

(58) Field of Classification Search

CPC . E21B 4/02; E21B 21/08; E21B 21/10; E21B 34/063; E21B 4/003; E21B 34/10; E21B 2200/04

See application file for complete search history.

(56) References Cited

U.S. PATENT DOCUMENTS

| | | | |
|---|---|---|---|
| 3,005,507 | A | 10/1961 | Clark, Jr. et al. |
| 3,989,114 | A | 11/1976 | Tschirky et al. |
| 4,298,077 | A | 11/1981 | Emery |
| 4,396,071 | A | 8/1983 | Stephens |
| 4,632,193 | A | 12/1986 | Geczy |
| 4,768,598 | A | 9/1988 | Reinhardt |
| 5,819,853 | A | 10/1998 | Patel |
| 6,095,249 | A | 8/2000 | McGarian et al. |
| 6,155,350 | A | 12/2000 | Melenyzer |

(Continued)

*Primary Examiner* — Taras P Bemko

(74) *Attorney, Agent, or Firm* — Matthews, Lawson, McCutcheon & Joseph, PLLC

(57) ABSTRACT

A drilling motor provides rotational force within a wellbore and includes a power section within the interior of a housing, a rotor positioned within the power section, and a passage within the rotor. The passage is configured to bypass a portion of the drilling mud from above the power section within the interior of the housing to below the power section within the interior of the housing, and an interior valve at a downstream end of the passage, wherein the valve includes a rupture disc configured to close the passage when the pressure from the drilling mud is less than a threshold pressure, and to rupture to open the passage and pass the drilling mud through the valve when the pressure from the drilling mud is greater than the threshold pressure.

13 Claims, 5 Drawing Sheets

(56) References Cited

U.S. PATENT DOCUMENTS

| | | | | |
|---|---|---|---|---|
| 6,202,762 | B1 | 3/2001 | Fehr et al. | |
| 6,263,969 | B1 | 7/2001 | Stoesz et al. | |
| 6,289,998 | B1 | 9/2001 | Krueger et al. | |
| 6,540,020 | B1 | 4/2003 | Falgout, Sr. | |
| 6,568,485 | B2 | 5/2003 | Falgout, Sr. | |
| 7,086,486 | B2 | 8/2006 | Ravensbergen et al. | |
| 8,534,379 | B2 | 9/2013 | Giroux et al. | |
| 9,404,326 | B2 | 8/2016 | Zhou | |
| 9,534,458 | B2 | 1/2017 | Duman et al. | |
| 2009/0095528 | A1 | 4/2009 | Hay et al. | |
| 2010/0032170 | A1 | 2/2010 | Howett et al. | |
| 2013/0008647 | A1* | 1/2013 | Dirksen ..... | E21B 21/08 166/250.01 |
| 2015/0300129 | A1 | 10/2015 | Hallundaek et al. | |

* cited by examiner

DRILLING MOTOR INTERIOR VALVE

PRIORITY

The present application is a continuation-in-part application of U.S. patent application Ser. No. 16/057,585, entitled "Drilling Motor Interior Valve" and filed on Aug. 7, 2018, which claims priority to U.S. Provisional Patent Application No. 62/542,259, entitled "Drilling Motor Interior Valve" and filed on Aug. 7, 2017, and to U.S. Provisional Patent Application No. 62/560,556, entitled "Drilling Motor Interior Valve" and filed on Sep. 19, 2017. The contents of prior applications are hereby incorporated by reference herein in their entirety.

FIELD

Embodiments usable within the scope of the present disclosure relate, generally, to bypass systems usable to divert and/or bypass the flow of drilling mud past a power section of a drilling motor. And more specifically, embodiments relate to flow control and/or interior valves usable to release pressure within a drill string above a drilling motor.

BACKGROUND

Drilling companies drill wellbores all over the world to extract water, hydrocarbons, or other useful materials from production zones that are sometimes many thousands of feet underground. To drill wellbores, drilling rigs often employ a rotating drill bit, which may be attached at the end of a string of tubulars. The rotating drill bit may include teeth at the bottom end that break up the rock. The broken rock can then be taken away to the surface. In some instances, the drilling rig rotates the entire string of tubulars from the surface of the wellbore. During other operations, however, the drill string remains rotationally stationary while the drill bit is rotated using a downhole motor (e.g., a progressive cavity positive displacement motor). Downhole motors may rotate an associated drill bit in response to the flow of drilling mud through the motor. The drilling mud may be pumped from the surface of the wellbore through the tubulars into a stator housing of the downhole motor. The pressure of the drilling fluid causes a rotor within the stator housing to rotate. The rate at which the borehole can be extended, often referred to as the ROP (rate of penetration), can be increased, in some circumstances, by increasing the amount of pressure delivered to the downhole motor.

In operations where a downhole motor is used, operators may often attempt to increase the ROP by increasing the load on the motor in excess of the tolerance of the downhole motor. If the motor lacks sufficient horsepower or momentum to continue the drilling operation, the motor may stall. In other situations, the characteristics of the formation or damage to the drill bit can contribute to stalling of the motor. During a stall, the drill bit stops rotating, and if drilling fluid is continuously provided to the downhole motor, a differential pressure across the motor can become extremely high. A differential pressure that is too high can cause severe damage to the motor, or some components of the motor (e.g., rubber, composite, elastomeric liner of the stator housing, and/or the flex shaft or tie-rod).

Stalls can often be mitigated by an operator, if a signal or indication of the pressure differential is communicated to the surface, and the operator responds to the signal or indication. Operators, however, can sometimes be unresponsive to the signal, or they can be influenced by the incentive to maximize the ROP in spite of the risk of a stall. Additionally, a drill bit may stall no matter what the operator does, if the formation varies in hardness or composition. Devices can be used to reduce the damage caused by a stall by absorbing or dampening forces from the drilling mud. However, many mechanical and electronic devices are prone to damage and/or failure. Additionally, mechanical forces used by such devices (e.g., rapid extension of springs, constant wearing of reciprocal movement) can cause damage to threaded connections, tools, and other components, interfering with measurements in instruments and sensors in the bottomhole assembly, and potentially un-torqueing connections in the tubular string. Devices occupy precious space within the tubular string, which can make them unsuitable for use within smaller strings and wellbores.

Further, the devices within a tubular string shunt the drilling fluid to the outside of the tubular string to relieve the excessive pressure from above the drilling motor. Shunting, however, can cause additional other problems. For example, the tubular string may include other drilling tools downhole from the downhole motor. These tools may include directional drilling, cutting removal, or other tools that depend on fluid pressure to function properly. If drilling fluid is shunted outside the tubular string, less of the fluid will be used to power those downhole tools.

A need exists for devices and methods usable to control the flow of drilling fluid through a power section of a downhole motor to reduce the likelihood of a stall and/or minimize damage to components should a stall occur.

A need also exists for devices and methods usable to power further downhole tools, while bleeding excess pressure from above the power section of a downhole motor.

Embodiments usable within the scope of the present disclosure meet these needs.

SUMMARY

Embodiments usable within the scope of the present disclosure include a drilling motor for providing rotational force within a wellbore. The drilling motor includes a housing comprising an interior and an exterior, wherein the housing is configured to connect to a drill string that receives drilling mud from the surface of the wellbore; a power section within the interior of the housing; a rotor positioned within the power section and configured to rotate in response to pressure from the drilling mud; a passage within the rotor, wherein the passage is configured to bypass a portion of the drilling mud from above the power section within the interior of the housing to below the power section within the interior of the housing; and an interior valve at a downstream end of the passage, wherein the valve includes a rupture disc configured to close the passage when the pressure from the drilling mud is less than a threshold pressure, and to rupture to open the passage and pass the drilling mud through the valve when the pressure from the drilling mud is greater than the threshold pressure.

In certain embodiments, the passage may be located through a center of the rotor. The valve may comprise a plurality of bypasses configured to disperse the drilling mud passing through the valve into an annulus below the power section. The plurality of bypasses may comprise an angle of travel that is less than 90 degrees with respect to an axis of the drilling motor. The plurality of bypasses may comprise a first bypass with an opening at a first longitudinal location, and a second bypass with an opening at a second longitudinal location.

Certain embodiments may also include a method for relieving pressure in a drilling motor. The method may include receiving a drilling mud to the drilling motor through a drilling string; rotating a rotor of the drilling motor, wherein the rotor rotates within a power section of a housing of the drilling motor in response to a pressure provided by the drilling mud, and wherein the rotor comprises an internal passage that is initially closed via an interior valve located within the drilling motor and at a downstream end of the passage, the interior valve comprising a rupture disc that closes the passage when the pressure from the drilling mud is less than a threshold pressure; and opening the interior valve by rupturing the rupture disc when the pressure from the drilling mud is above the threshold pressure, wherein opening the valve bypasses a portion of the drilling mud through the passage within the rotor, wherein the passage flows from above the power section within the housing to below the power section within the housing.

Certain embodiments of the method may also include dispersing the drilling mud through a plurality of bypasses after the drilling mud flows through the passage. The method may include powering a downhole tool with drilling mud below the power section of the drilling motor. Powering the downhole tool may comprise powering a drill bit, a reamer, a MWD, an LWD, a pulser valve, a rotary steerable, any other downhole tool, or combinations thereof. The method may include forcing the drilling mud from a drill bit nozzle, wherein all the drilling mud is forced through the drill bit nozzle.

Certain embodiments may also include a system for drilling a well. The system may include a drill string configured to convey drilling mud from a surface pump; a drilling motor connected to the drill string, comprising: a housing comprising an interior and an exterior, wherein the housing is configured to connect to the drill string; a power section within the interior of the housing; a rotor positioned within the power section and configured to rotate in response to pressure from the drilling mud; a passage within the rotor, wherein the passage is configured to bypass a portion of the drilling mud from above the power section within the interior of the housing to below the power section within the interior of the housing; and an interior valve at a downstream end of the passage, wherein the valve includes a rupture disc configured to close the passage when the pressure from the drilling mud is less than a threshold pressure, and to rupture to open the passage and pass drilling mud through the valve when the pressure from the drilling mud is greater than the threshold pressure. The system further includes a drill bit connected to, and configured to rotate with, the rotor, wherein the drill bit comprises drilling nozzles that spray the drilling mud; and an additional downhole tool configured to be powered by the drilling mud.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed figures.

DETAILED DESCRIPTION OF THE EMBODIMENTS

Before describing selected embodiments of the disclosure in detail, it is to be understood that the disclosure is not limited to the particular embodiments described herein. The disclosure and description herein is illustrative and explanatory of one or more example embodiments, and it will be appreciated by those skilled in the art that various changes in the design, organization, order of operation, means of operation, equipment structures and location, methodology, and use of mechanical equivalents may be made without departing from the spirit of this disclosure.

As well, it should be understood the drawings are intended to illustrate and disclose example embodiments to one of ordinary skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of this disclosure as described herein.

Moreover, it will be understood that various directions such as "upper", "lower", "bottom", "top", "left", "right", and so forth are made only with respect to explanation in conjunction with the drawings, and that the components may be oriented differently, for instance, during transportation and manufacturing as well as operation. Because many varying and different embodiments may be made within the scope of the inventive concept(s) herein taught, and because many modifications may be made in the embodiments described herein, it is to be understood that the details herein are to be interpreted as illustrative and non-limiting.

Figure 1:
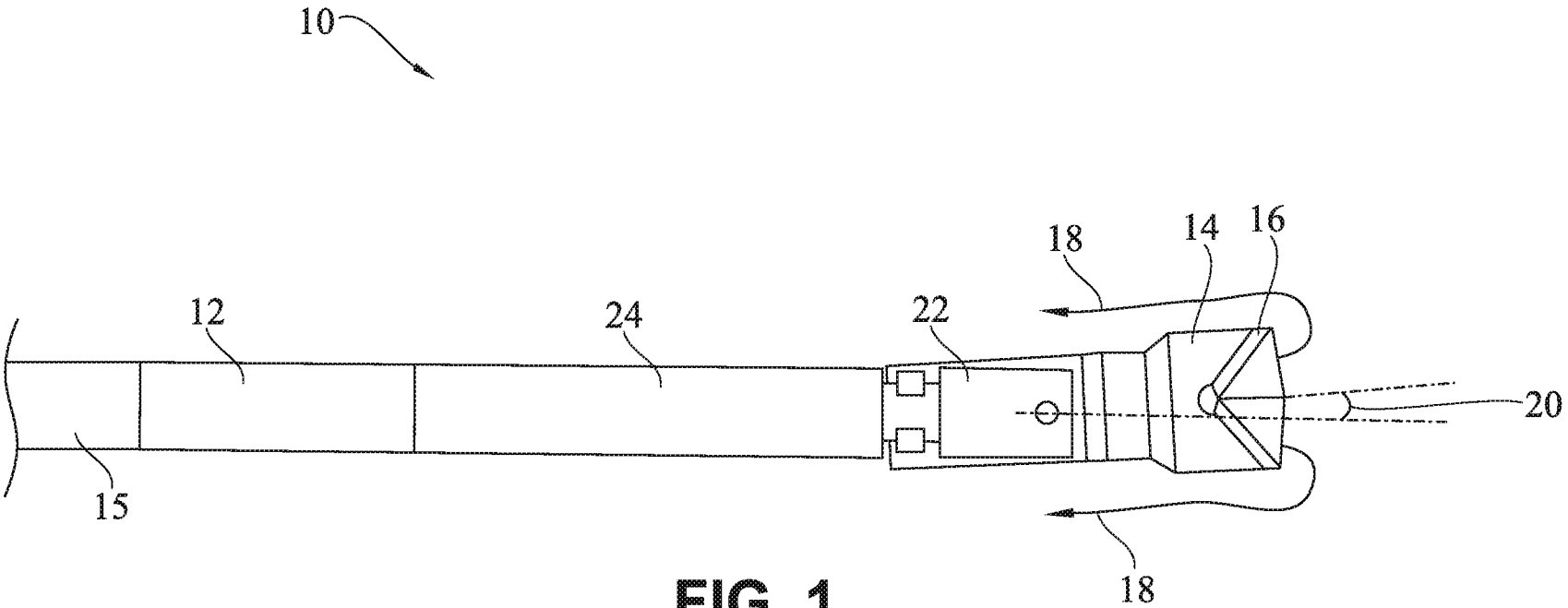
FIG. 1 depicts an embodiment of a downhole drilling system having a drilling motor with a release valve.

FIG. 1 depicts an embodiment of a downhole drilling system 10 having a drilling motor 12. The drilling motor 12 powers a drill bit 14 that may be used to drill a wellbore into, for example, production zones for the extraction of hydrocarbons, water, other fluids, or combinations thereof. The drill bit 14 may be connected to a drill string 15 that conveys pressurized drilling mud from a surface pump at the surface of the wellbore. The drilling motor 12 converts pressure from the drill string 15 into rotational force to rotate the drill bit 14 against the rock formations at the bottom of the wellbore. In addition to powering the drilling motor 12, in certain embodiments the drilling mud is forcefully sprayed from nozzles 16 that are part of, or located near, the drill bit 14. After being sprayed from the nozzles 16, the drilling mud flows upward 18 through the wellbore on the outside/exterior of the drill string 15 to the surface. The drilling mud carries the cuttings (e.g., rock, soil, fluid) to the surface so that the drill bit 14 can be in constant contact with the bottom of the wellbore. If the cuttings are not carried away, the drill bit 14 may rotate without drilling, which decreases efficiency. As will be illustrated in detail below, the drilling motor 12, and the disclosed embodiments of interior valves, enable all drilling mud to flow through the nozzles 16, enabling full efficiency for conveying cuttings away from the drill bit 14.

The drilling system 10 depicted in FIG. 1 also includes a rotary steerable tool 22 that can adjust the angle 20 that the drill bit 14 takes with respect to the rest of the drill string 15. Adjusting the angle 20 enables the operator of the drilling system 10 to curve the wellbore as it is drilled. For example, the wellbore may be directed to drill horizontally to better access a production zone containing hydrocarbons. The rotary steerable tool 22 may use pressure provided by the drilling mud to power electronic or hydraulic actuators for controlling the angle 20 of drilling. Furthermore, the drilling system 10 may include additional downhole tools 24 at the end of the drill string 15 that also utilize drilling mud for power. For example, the drilling system 10 may include a reamer, a measurement while drilling (MWD) surveying tool, a logging while drilling (LWD) serving tool, a pulser valve, or any combinations thereof. The downhole tools 24 may mechanically convert the pressure from the drilling mud, or may use an electric generator to convert the pressure into electric potential to power electronic equipment. For these downhole tools 24, any loss of pressure in the drilling mud can result in inaccurate or poor results.

Figure 2:
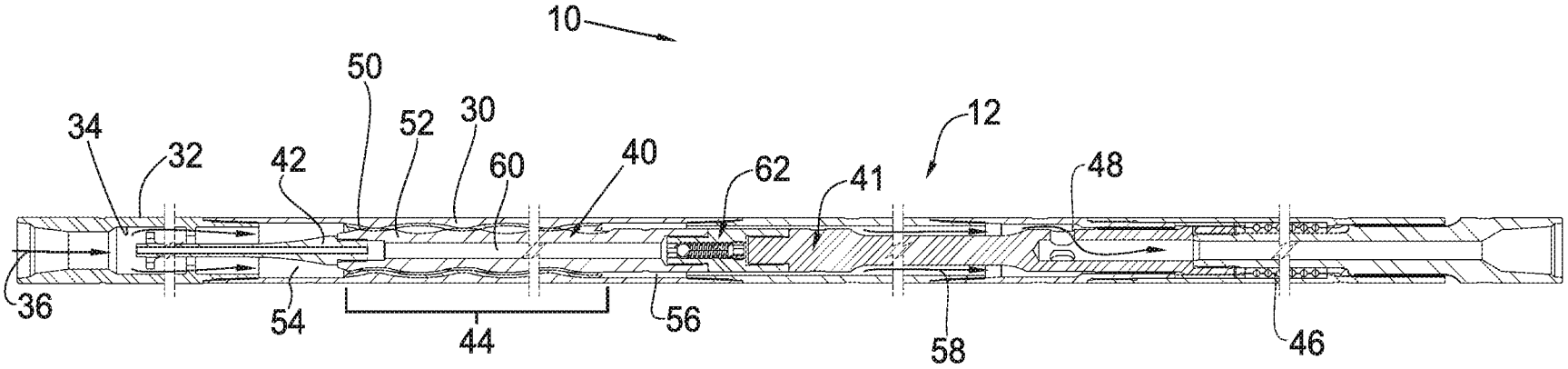
FIG. 2 depicts an embodiment of a drilling motor that may be used to power a drill bit for digging a wellbore.

FIG. 2 depicts an embodiment of a drilling motor 12 that may be used as part of the drilling system 10 to power the drill bit 14 for excavating a wellbore. The drilling motor 12 may include a housing 30 having an exterior 32 and an interior 34. Within the interior 34, a flow of drilling mud 36 is conveyed from the surface of the wellbore through the drill string 15. As shown, the drilling mud 36 flows into a rotor 40 that converts the pressure and the motion of the drilling mud 36 into rotational motion that can be used to power the drill bit 14 and/or other downhole tools 24. The drilling motor 12 may include a rotor catch mechanism 42, a power section 44, bearings 46, and flow diverter holes 48. As the drilling mud 36 flows, the bearings 46 keep the rotor 40 stabilized and enable the rotor 40 to rotate with respect to the housing 30 so that the housing 30, drill string 15, and any downhole tools 24 connected to the housing 30 may remain rotationally stationary during drilling. The rotational power produced by the power section 44 can be conveyed to the drill bit by a transmission 41, as shown. The flow diverter holes 48 enable the drilling mud 36 to flow down the center of the drilling system 10 and out through the nozzles 16 of the drill bit 14.

In the illustrated embodiment, the power section 44 includes a sealing elastomer 50 and rotor lobes 52. Various configurations may be used for the shape and configuration of the sealing elastomer 50 and rotor lobes 52. Whatever the configuration, as the drilling mud 36 flows from a higher pressure area 54 above the power section 44 to a lower pressure area 56 in an annulus 58 below the power section 44, the rotor 40 converts the pressure and motion into rotation. The difference between the higher pressure in the higher pressure area 54 and the lower pressure in the lower pressure area 56 may be 500-5000 psi, 1500-4500 psi, 2000-2500 psi, or other ranges depending on the size and shapes of the drilling system 10, drilling motor 12, wellbore, and the characteristics of the rock formations that are being drilled. The rotational speed of the rotor 40 may increase with an increase in pressure in the higher pressure area 54, but only to a certain point. Operators at the surface of the wellbore may increase the pressure beyond the capability of the rotor 40 to convert into rotational energy. That is, at a certain point increasing the pressure of the drilling mud 36 starts to degrade the components within the interior 34 of the drilling motor 12. Specifically, the sealing elastomer 50, which may be made out of polymers or rubber, may wear out prematurely if the pressure is too high. In certain embodiments, the drilling motor 12 may include release valves or sleeve valves that jettison drilling mud 36 from the higher pressure area 54 to the exterior 32 before the drilling mud 36 can damage the sealing elastomer 50. These embodiments, however, can suffer from the lack of drilling mud 36 below the rotor 40, decreasing the ability of the downhole tools 24 to function with full power, and the ability of the nozzles 16 to sufficiently convey the cuttings from the drill bit 14.

The illustrated embodiment includes a passage 60 within the rotor 40 of the power section 44 that enables the drilling mud 36 to bypass the power section 44 and remain within the interior 34 so that the downhole tools 24 and the nozzles 16 may work at full efficiency. The passage 60 may begin at a top end of the rotor catch mechanism 42, as illustrated, but may also include an opening through the rotor catch mechanism 42, or other components of the rotor 40 above the power section 44. The flow of drilling mud 36 through the passage 60 can be controlled by an interior valve 62 that mechanically stops the flow of drilling mud 36 until the pressure in the higher pressure area 54 reaches a threshold pressure. If the drilling mud 36 has a pressure below the threshold pressure, the interior valve 62 remains closed and no drilling mud 36 passes through the passage 60. If the drilling mud 36 rises in pressure above the threshold pressure, then the interior valve 62 will open up, and drilling mud 36 will flow through the passage 60, bypassing the rotor 40 of the power section 44.

Figure 3:
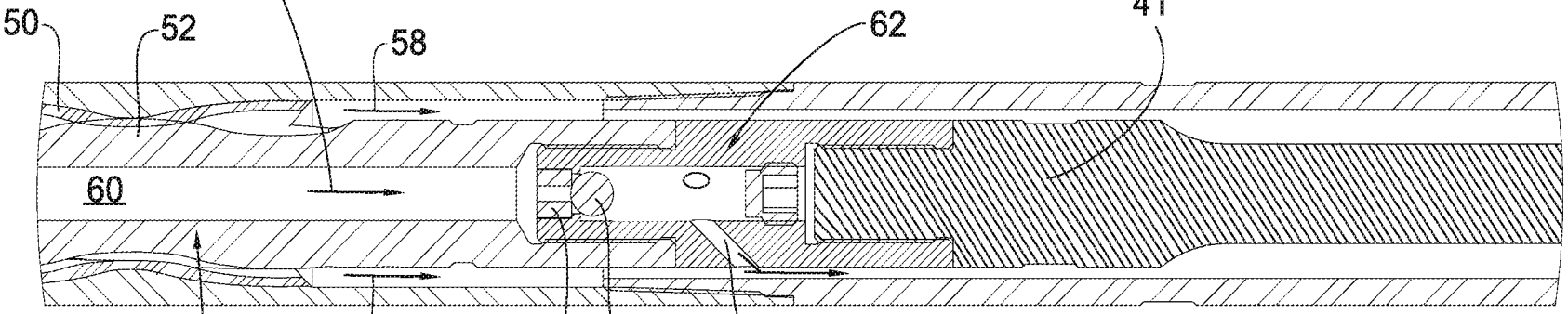
FIG. 3 depicts an inset view of an embodiment of the drilling motor depicted in FIG. 2.

FIG. 3 depicts an inset view of an embodiment of the interior valve 62 installed within the drilling motor 12 depicted in FIG. 2. As shown, the passage 60 may be located at the radial center of the rotor 40. The drilling mud 36 within the passage 60 is pressurized to the same pressure as the drilling mud 36 at the higher pressure area 54. The interior valve 62 provides a closing force that stops the drilling mud 36 from flowing through the passage 60 or the interior valve 62. The closing force may be provided, for example, by a ball 66 that is forced against a valve nozzle 64. In other embodiments, the interior valve 62 may be kept closed by a flapper, a sleeve, a compression sleeve, a differently shaped ball valve, or other valve configured to provide a closing force within the passage 60. When the drilling mud 36 within the passage 60 rises above the threshold pressure, the closing force provided by the interior valve 62 is no longer sufficient to keep the ball 66 against the valve nozzle 64. When the closing force is overcome, the drilling mud 36 begins to flow through the valve nozzle 64, and out through bypasses 68, to convey the drilling mud 36 from the passage 60, back out into the annulus 58, and between the transmission 41 and the interior 34 of the drilling motor 12. As long as the pressure of the drilling mud 36 is higher than the threshold pressure, the interior valve 62 may remain open. This is useful if, for example, an operator at the surface pump does not notice (or does not heed) indications that the pressure within the drill string 15 is higher than recommended.

If at some future time the pressure of the drilling mud 36 drops below the threshold pressure, the interior valve 62 closes once again, and all of the drilling mud 36 will flow through the power section 44 once more. This cycle of opening and closing the interior valve 62 may occur multiple times during the drilling of a wellbore. For example, a single wellbore may pass through a multitude of rock layers that each have varying degrees of hardness. If the drilling system 10 drills through a relatively softer rock layer and encounters a relatively harder rock layer, the drill bit 14 may slow down, causing the pressure to rise within the drill string 15. Before the increased pressure damages the sealing elastomer 50, however, the interior valve 62 opens and bypasses drilling mud 36 through the passage 60 until an operator responds, or the drilling system 10 drills through the harder rock layer.

Figure 4:
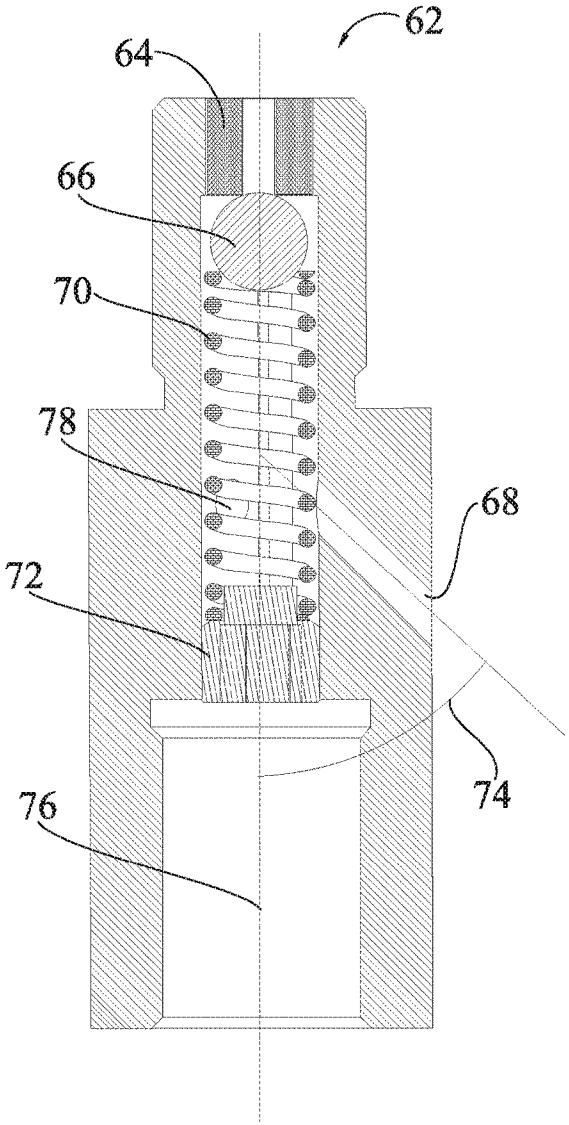

FIG. 4 depicts a cross-sectional side view an embodiment of an interior valve 62 that may be used as part of the drilling motor 12 depicted in FIG. 3. The interior valve 62 in this embodiment includes a valve nozzle 64, with a cylindrical nozzle hole and a spherical ball 66 that are forced together to shut off the passage 60. The interior valve 62 also includes a coil spring 70 that provides the closing force to the spherical ball 66. The material and shape of the coil spring 70 can determine an amount of force that is required to depress the spring over a given distance. Understanding these characteristics can lead to the controlling of the closing force through the use of an adjustment member, such as a set screw 72. If the set screw 72 is adjusted closer to the valve nozzle 64, the coil spring 70 pushes with a greater force on the spherical ball 66, increasing the closing force and raising the pressure at which the interior valve 62 will open.

Figure 6:
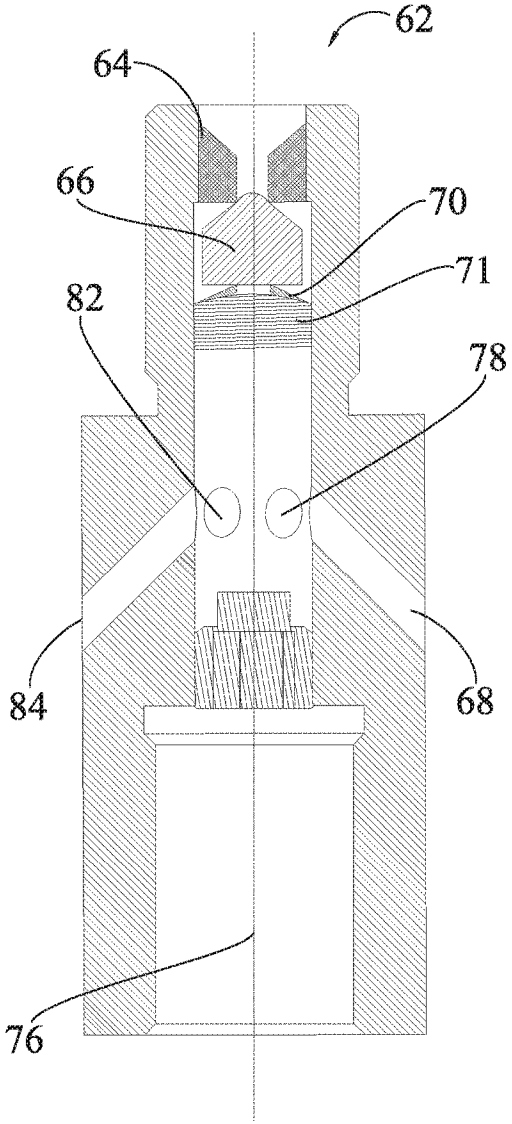
FIGS. 4-6 depict cross-sectional side views of embodiments of interior valves that may be used as part of the drilling motor depicted in FIG. 3.
Figure 5:
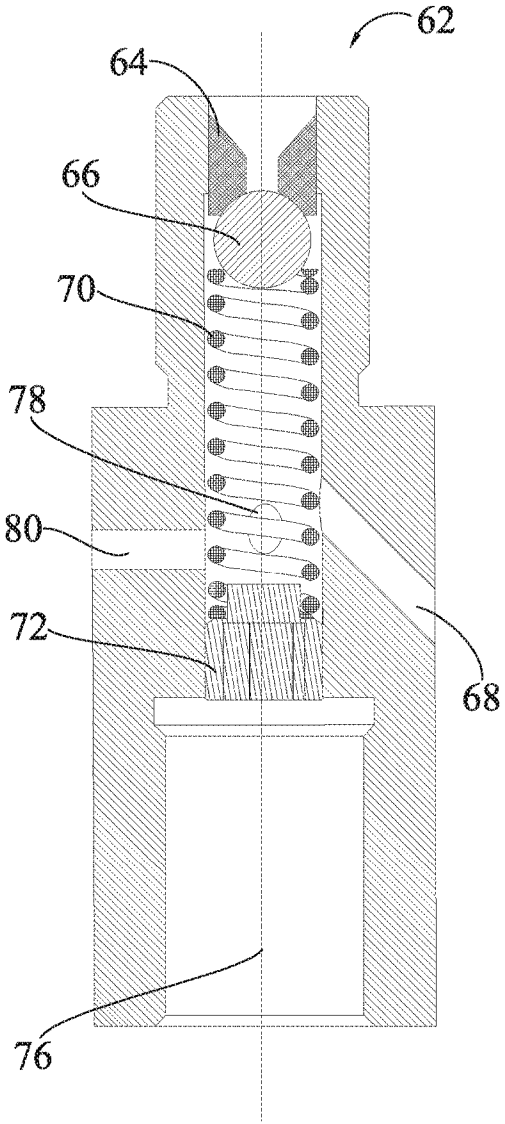

Once the interior valve 62 is open, the drilling mud 36 flows through the valve nozzle 64 and out through a first bypass 68 (also shown in FIG. 3). The first bypass 68 may direct the drilling mud 36 at an angle 74 relative to an axis 76 of the drilling motor 12 and/or interior valve 62. A second bypass 78 may be located at a location around the circumference of the interior valve 62. The second bypass 78 may include the same angle 74, or a different angle relative to the axis 76. FIG. 4 shows that the second bypass 78 may be located at the same longitudinal distance as the first bypass 68. Furthermore, the interior valve 62 may include other bypasses (see 82, 84, of FIG. 6) spaced evenly or randomly (i.e., varying the distance along the part, varying the angles between the bypasses, or varying the flow angle of the bypasses) about the interior valve 62. The embodiment illustrated in FIG. 4, for example, includes 3 bypasses (one bypass not shown in FIG. 4), each bypass positioned 120 degrees from the neighboring passes. As illustrated in FIGS. 5 and 6, however, the angle 74, longitudinal location, or number of the bypasses may be adjusted between various embodiments of the interior valve 62.

FIG. 5 depicts a cross-sectional side view of an embodiment of the interior valve 62 that may be used as part of the drilling motor 12 depicted in FIG. 3. The interior valve 62 illustrated in FIG. 5 includes the spherical ball 66 and the coil spring 70, but the valve nozzle 64 includes a conical hole rather than the cylindrical hole illustrated in FIG. 4. Furthermore, the underside of the valve nozzle 64 may be machined, as illustrated, to match the shape of the spherical ball 66. This may enable a tighter sealing and a more accurate calibration of the closing force between the spherical ball 66 and the valve nozzle 64. Also different from the embodiment illustrated in FIG. 4, the interior valve 62 of FIG. 5 includes a third bypass 80 in addition to first bypass 68 and second bypass 78, illustrated in the displayed half of the cross-sectional view. The third bypass 80 makes an angle that is square to the axis 76 and thus directs the drilling mud 36 directly into the interior 34 of the housing 30. The interior valve 62 illustrated in FIG. 5 may include 6 bypasses evenly spaced every 60 degrees about the circumference of the interior valve 62. These bypasses may be located at differing longitudinal locations such that a descending spiral of bypasses is formed. Other numbers of bypasses can be included in various other embodiments of the interior valve 62.

FIG. 6 depicts a cross-sectional side view of an embodiment of the interior valve 62 that may be used as part of the drilling motor 12 depicted in FIG. 3. The interior valve 62 includes a ball 66 that is conical rather than spherically shaped, and has an adjustment member that is a spring washer 70 rather than a coil spring. The spring washer 70 may push against the ball 66 with a specific amount of force, only opening when the pressure above the ball 66 has enough force to deform the spring washer 70. The amount of force required to deform the spring washer may be calibrated by adjusting the position of the spring washer 70 using threads 71 on the inside wall of the interior valve 62. Rotating the spring washer 70 closer to the ball 66 along the threads 71 may increase the closing force, while rotating the spring washer 70 away from the ball 66 along the threads 71 may decrease the closing force.

Figure 7:
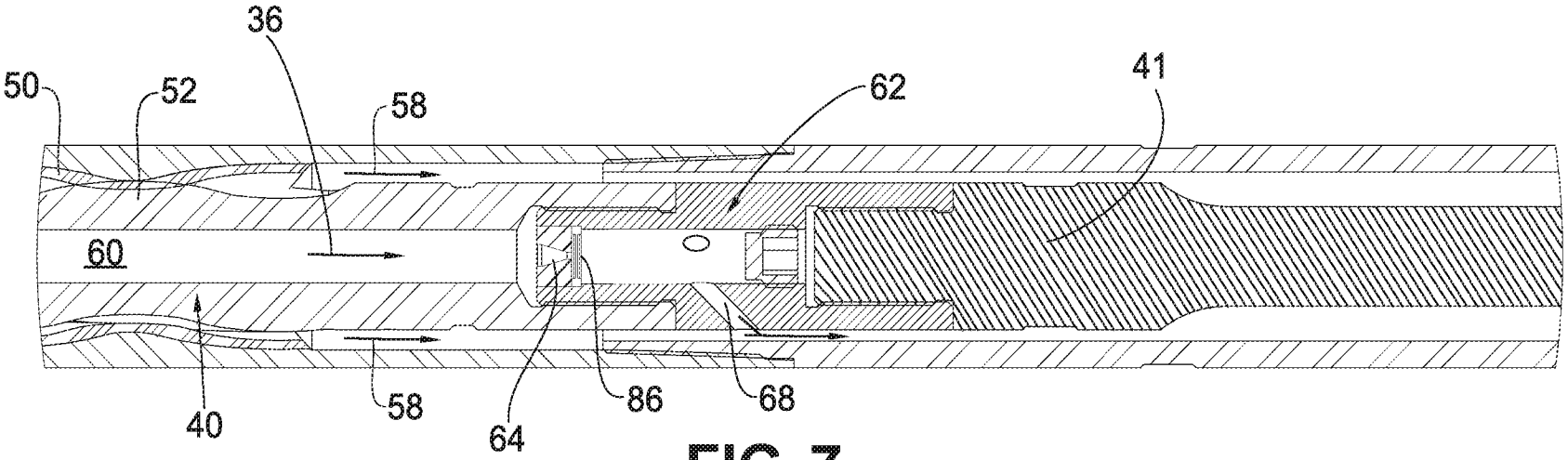
FIG. 7 depicts an inset view of an alternative drilling motor having a valve that includes rupture disc according to an embodiment.

FIG. 7 depicts an inset view of an alternative embodiment of the interior valve 62 installed within the drilling motor 12 depicted in FIG. 2. The drilling motor 12 may be the same as the drilling motor in FIG. 2, and may include similar components along with the interior valve 62. The difference in the alternative embodiment of FIG. 7 is that the interior valve 62 includes a rupture disc 86, instead of the ball 66. The rupture disc 86 initially closes the passage 60 to stop the drilling mud 36 from flowing through the passage 60 or the interior valve 62. The rupture disc 86 may be located against the valve nozzle 64, so that the rupture disc 86 is provided below, or in other words, at a downstream end, of the passage 60 at the base of the power section 44. This allows some of the drilling mud 36 to already be contained within the passage 60 of the rotor 40 even before drilling mud 36 is passed through the valve nozzle 64, so that distribution of the drilling mud 36 through the valve nozzle 64 and to the downhole tools 24, as discussed below, occurs sooner than if the valve nozzle 64 was located at the upstream end of the passage 60.

When the pressure from the pressurized drilling mud 36 is less than a threshold pressure, the rupture disc 86 prevents the drilling mud 36 from exiting the passage 60 so that all of the drilling mud 36 is used to drive the power section 44 and any additional downhole tools 24. When the drilling mud 36 within the passage 60 rises above the threshold pressure, the closing force provided by the rupture disc 86 is no longer sufficient, and the rupture disc 86 breaks. The broken rupture disc 86 allows the drilling mud 36 to flow through the passage 60 and the valve nozzle 64, and out through bypasses 68, to convey the drilling mud 36 from the passage 60, back out into the annulus 58, between the transmission 41 and the interior 34 of the drilling motor 12, and to the downhole tools 24. In this manner, the drilling mud 36 is still able to power the downhole tools 24 at full efficiency. With the drilling mud 36 above the threshold pressure flowing through the passage 60, less of the pressurized drilling mud 36 powers the power section 44, so that the drilling motor 12 is throttled back at a weaker rate. Breaking or bursting of the rupture disc 86, and the corresponding loss of motor power, can be an indicator to the drilling motor operator at the surface pump that the pressure of the drilling mud 36 is too strong for the capacity of the drilling motor 12. This is useful to prevent or reduce damage to the drilling motor 12 if, for example, the operator at the surface pump does not notice (or does not heed) indications that the pressure within the drill string 15 is higher than recommended.

Figure 8:
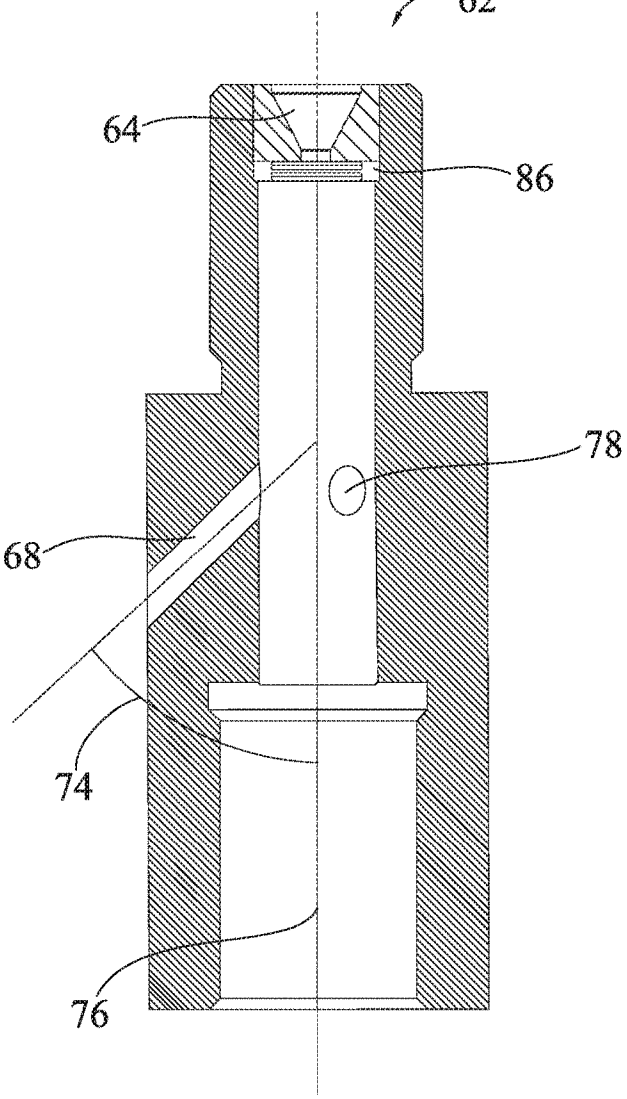
FIG. 8 depicts a cross-sectional side view of the valve that includes the rupture disc as depicted in FIG. 7.

FIG. 8 depicts a cross-sectional side view of the interior valve 62 that may be used as part of the drilling motor 12 depicted in FIG. 7 according to an embodiment. The interior valve 62 includes the valve nozzle 64, which includes a conical hole rather than the cylindrical hole illustrated in FIG. 4. The rupture disc 86 is located against the valve nozzle 64 to shut off the passage 60. The rupture disc 86 may be formed of stainless steel, Inconel, or other suitable material, so that the rupture disc 86 is able to withstand a pressure from the drilling mud 36 in the range of 2,000 psi to 3,000 psi before rupturing. The rupture disc 86 may include a rubber sealing surface around the perimeter thereof.

When the rupture disc 86 bursts to open the interior valve 62, the drilling mud 36 flows through the valve nozzle 64 and out through at least a first bypass 68. The first bypass 68 may direct the drilling mud 36 at an angle 74 relative to an axis 76 of the drilling motor 12 and/or interior valve 62. A second bypass 78 may be located at a location around the circumference of the interior valve 62. The second bypass 78 may include the same angle 74, or a different angle relative to the axis 76. FIG. 8 shows that the second bypass 78 may be located at the same longitudinal distance as the first bypass 68. Furthermore, the interior valve 62 may include other bypasses (similar to bypasses 82, 84, of FIG. 6) spaced evenly or randomly (i.e., varying the distance along the part, varying the angles between the bypasses, or varying the flow angle of the bypasses) about the interior valve 62. The embodiment illustrated in FIG. 8 may include 3 bypasses, each bypass positioned 120 degrees from the neighboring bypasses.

While various embodiments usable within the scope of this disclosure have been described with emphasis, it should be understood that within the scope of the appended claims, the invention can be practiced other than as specifically described herein.

What is claimed is:

1. A drilling motor for providing rotational force within a wellbore, comprising:

a housing comprising an interior and an exterior, wherein the housing is configured to connect to a drill string that receives drilling mud from the surface of the wellbore;

a power section within the interior of the housing;

a rotor positioned within the power section and configured to rotate in response to pressure from the drilling mud;

a passage within the rotor, wherein the passage is configured to bypass a portion of the drilling mud from above the power section within the interior of the housing to below the power section within the interior of the housing; and an interior valve at a downstream end of the passage, wherein the valve includes an internal bore, a valve nozzle provided inside the internal bore, and a rupture disc positioned against the valve nozzle, the rupture disc configured to close the passage when the pressure from the drilling mud is less than a threshold pressure, and to rupture to open the passage and pass the drilling mud through the valve when the pressure from the drilling mud is greater than the threshold pressure.

2. The drilling motor of claim 1, wherein the passage is located through a center of the rotor.

3. The drilling motor of claim 1, wherein the valve comprises a plurality of bypasses configured to disperse the drilling mud passing through the valve into an annulus below the power section.

4. The drilling motor of claim 3, wherein the plurality of bypasses comprise an angle of travel that is less than 90 degrees with respect to an axis of the drilling motor.

5. The drilling motor of claim 3, wherein the plurality of bypasses comprise a first bypass with an opening at a first longitudinal location, and a second bypass with an opening at a second longitudinal location.

6. A method for relieving pressure in a drilling motor, comprising:

receiving a drilling mud to the drilling motor through a drilling string;

rotating a rotor of the drilling motor, wherein the rotor rotates within a power section of a housing of the drilling motor in response to a pressure provided by the drilling mud, and wherein the rotor comprises an internal passage that is initially closed via an interior valve located within the drilling motor and at a downstream end of the passage, the interior valve comprising an internal bore, a valve nozzle provided inside the internal bore, and a rupture disc positioned against the valve nozzle, the rupture disc closing the passage when the pressure from the drilling mud is less than a threshold pressure; and opening the interior valve by rupturing the rupture disc when the pressure from the drilling mud is above the threshold pressure, wherein opening the valve bypasses a portion of the drilling mud through the passage within the rotor, wherein the passage flows from above the power section within the housing to below the power section within the housing.

7. The method of claim 6, comprising dispersing the drilling mud through a plurality of bypasses after the drilling mud flows through the passage.

8. The method of claim 6, comprising powering a downhole tool with drilling mud below the power section of the drilling motor.

9. The method of claim 8, wherein powering the downhole tool comprises powering a drill bit, a reamer, a MWD, an LWD, a pulser valve, a rotary steerable, any other downhole tool, or combinations thereof.

10. The method of claim 6, comprising forcing the drilling mud from a drill bit nozzle, wherein all the drilling mud is forced through the drill bit nozzle.

11. A system for drilling a well, comprising:

a drill string configured to convey drilling mud from a surface pump;

a drilling motor connected to the drill string, comprising:

a housing comprising an interior and an exterior, wherein the housing is configured to connect to the drill string;

a power section within the interior of the housing;

a rotor positioned within the power section and configured to rotate in response to pressure from the drilling mud;

a passage within the rotor, wherein the passage is configured to bypass a portion of the drilling mud from above the power section within the interior of the housing to below the power section within the interior of the housing; and an interior valve at a downstream end of the passage, wherein the valve includes an internal bore, a valve nozzle provided inside the internal bore, and a rupture disc positioned against the valve nozzle, the rupture disc configured to close the passage when the pressure from the drilling mud is less than a threshold pressure, and to rupture to open the passage and pass drilling mud through the valve when the pressure from the drilling mud is greater than the threshold pressure;

a drill bit connected to, and configured to rotate with, the rotor, wherein the drill bit comprises drilling nozzles that spray the drilling mud; and an additional downhole tool configured to be powered by the drilling mud.

12. The system of claim 11, wherein the additional downhole tool comprises a bit, a reamer, a MWD, an LWD, a pulser valve, a rotary steerable, any other downhole tool, or combinations thereof.

13. The system of claim 11, wherein the passage is located through a center of the rotor.

* * * * *